US007270100B2

(12) United States Patent
Ruppel et al.

(10) Patent No.: US 7,270,100 B2
(45) Date of Patent: Sep. 18, 2007

(54) ELECTRIC START MINI-CULTIVATOR

(75) Inventors: Mark Ruppel, Cumberland, WI (US); Ronald Ruppel, Cumberland, WI (US)

(73) Assignee: Ardisam, Inc., Cumberland, WI (US)

( * ) Notice: Subject to any disclaimer, the term of this patent is extended or adjusted under 35 U.S.C. 154(b) by 0 days.

(21) Appl. No.: 11/477,193

(22) Filed: Jun. 27, 2006

(65) Prior Publication Data

US 2007/0006839 A1 Jan. 11, 2007

Related U.S. Application Data

(63) Continuation-in-part of application No. 11/071,491, filed on Mar. 3, 2005, now abandoned.

(51) Int. Cl.
*F02N 11/00* (2006.01)
*F02N 3/02* (2006.01)

(52) U.S. Cl. ..... 123/179.24; 123/179.25

(58) Field of Classification Search ..... 123/179.24, 123/179.25, 179.28, 185.2, 185.3, 185.4, 123/185.1; 172/42
See application file for complete search history.

(56) References Cited

U.S. PATENT DOCUMENTS 111,885 A * 2/1871 Deutsch ..... 73/444
3,536,051 A * 10/1970 Hamman ..... 123/179.26
3,596,647 A * 8/1971 Heisler ..... 123/179.26
4,421,176 A * 12/1983 Tuggle et al. ..... 172/41
4,909,200 A * 3/1990 Sumi ..... 123/179.24
5,345,900 A * 9/1994 Wisegerber ..... 123/179.24
6,218,799 B1 * 4/2001 Hori ..... 318/446
6,540,031 B1 * 4/2003 Sasaoka ..... 172/42
2005/0229889 A1 * 10/2005 Hoevermann ..... 123/179.4

* cited by examiner

*Primary Examiner*—Stephen K. Cronin
*Assistant Examiner*—Arnold Castro
(74) *Attorney, Agent, or Firm*—Gerald E. Helget; Briggs and Morgan, P.A.

(57) ABSTRACT

An electric starter for a walk-behind, powered, rotary cultivator having a gasoline engine having a crankshaft and a recoil starter connected to the gasoline engine. The electric starter includes an electric motor connected to the crankshaft between the recoil starter and the engine so that activation of the electric motor starts the engine and the recoil starter can also be used to start the engine; a battery connected to the electric motor; a start switch between the battery and the electric motor; and a battery charger. The electric starter is intended for use on cultivators generally having less than about 2 horsepower. The recoil starter is intermittently engageable with the crankshaft through the electric motor. The electric motor may also act as a generator supplying electric current to the battery to charge the battery.

18 Claims, 5 Drawing Sheets

ELECTRIC START MINI-CULTIVATOR

The present application is a continuation-in-part of application Ser. No. 11/071,491, filed Mar. 3, 2005.

BACKGROUND OF THE INVENTION

The present invention relates to a hand supported cultivator as defined in ANSI/OPEI B71.8-1996, and in particular to a hand-supported cultivator with an electric starting motor.

Hand supported cultivators (also known as mini-cultivators) are operator controlled (walk-behind) powered rotary cultivators (generally less than 2 hp), comprised of two handles intended to be easily hand supported by the operator. The rotating tines/tool(s) ensure propulsion away from the operator.

Such mini-cultivators have in the past been hand-started by means of a recoil cord that is pulled by the operator, which then turns the crankshaft to start the engine. A problem with such mini-cultivators is that they are difficult to start using this method.

There is a need for a mini-cultivator with an electric start.

SUMMARY OF THE INVENTION

An electric starter for a walk-behind, powered, rotary cultivator having a gasoline engine having a crankshaft and a recoil starter connected to the gasoline engine, the electric starter comprising:

an electric motor directly connected to the engine between the recoil starter and the engine whereby activation of the electric motor starts the engine and whereby the recoil starter can also be used to start the engine;

a battery connected to the electric motor;

a start switch between the battery and the electric motor;

a battery charger; and wherein the cultivator generally has less than about 2 horsepower.

DETAILED DESCRIPTION OF THE PREFERRED EMBODIMENT

Figure 1:
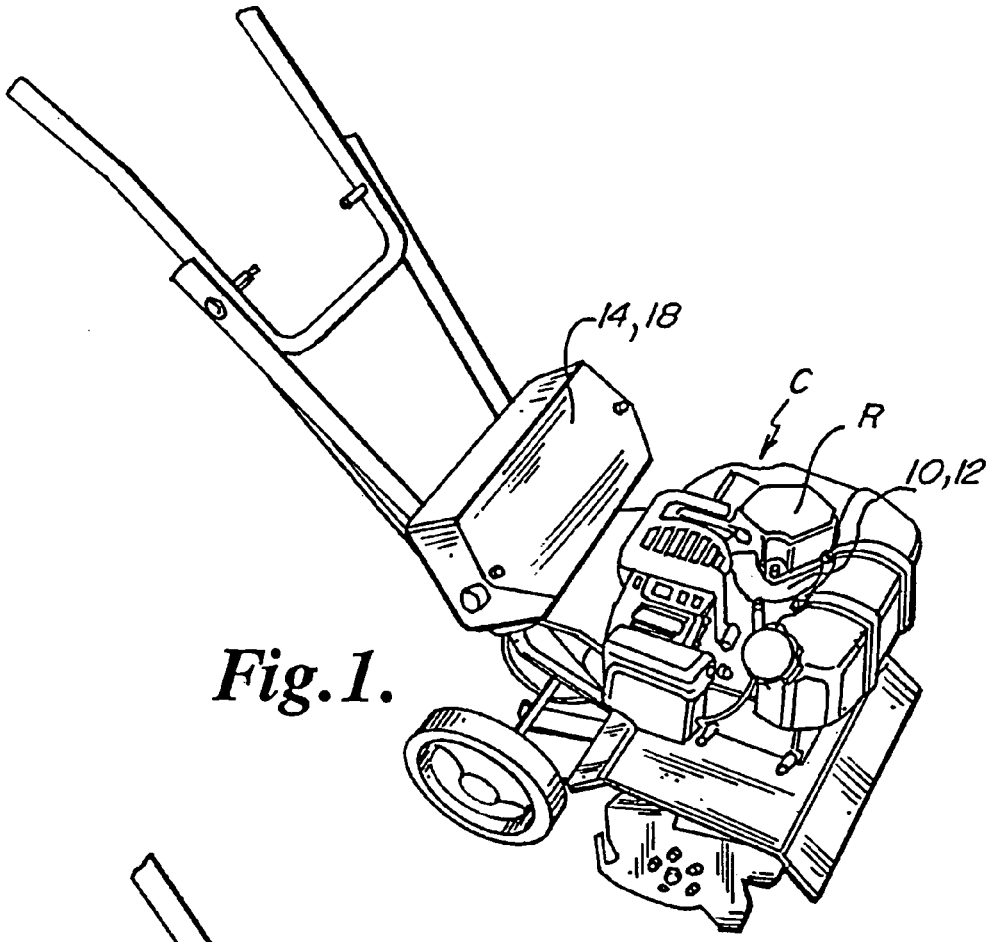
FIG. 1 is a front perspective of the cultivator having the present invention attached.
Figure 2:
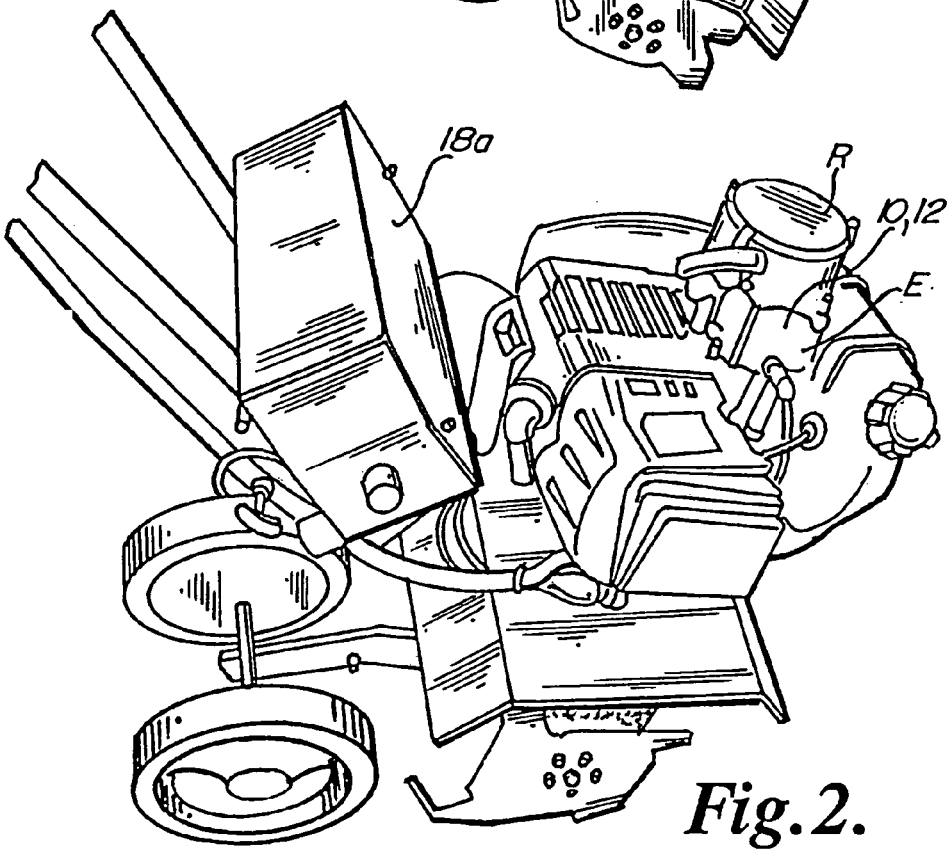
FIG. 2 is a side perspective similar to FIG. 1.
Figure 3:
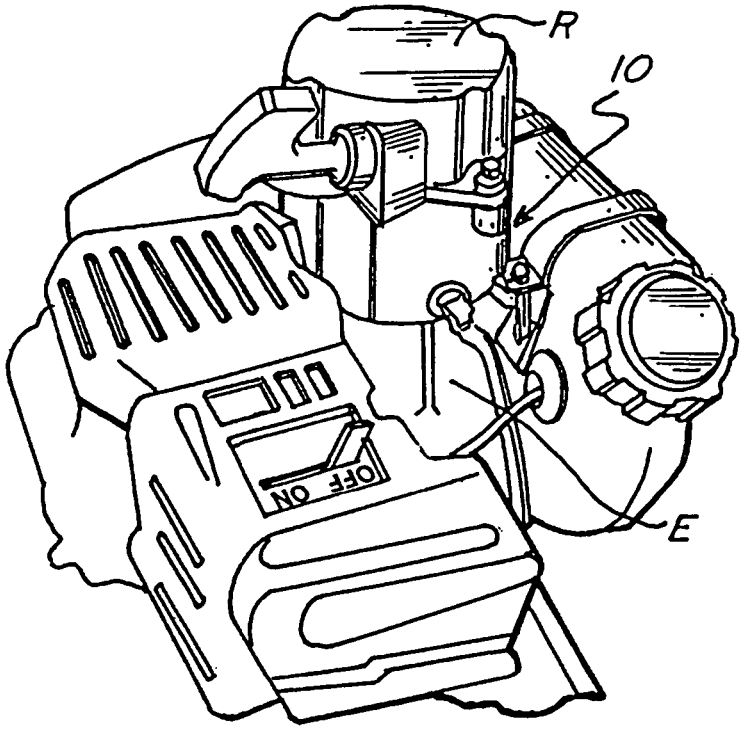
FIG. 3 is a close-up perspective of the present invention and its surroundings.
Figure 4:
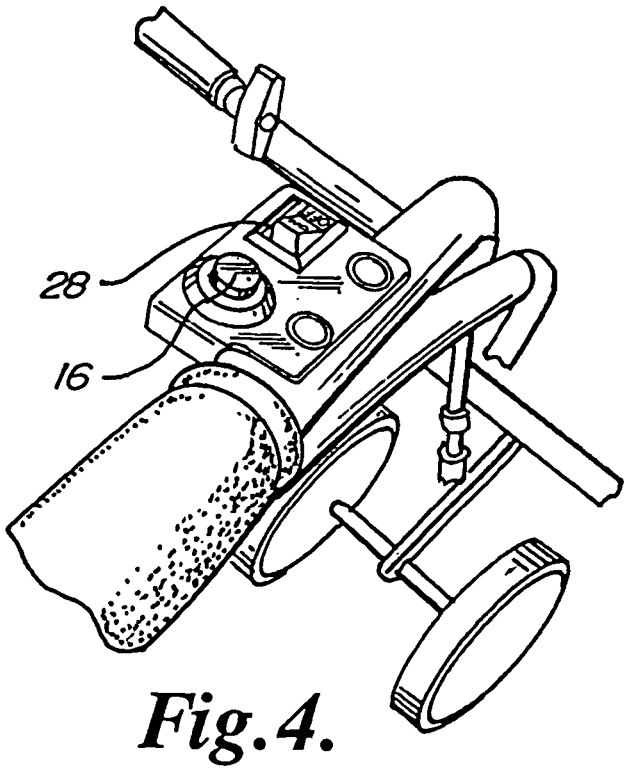
FIG. 4 is a top perspective of the cultivator having the present invention attached.

The present invention is generally designated in the Figures as reference numeral 10.

The present invention is an electric starter 10 for a walk-behind cultivator C having an engine E and a recoil starter R. In the usual case, the recoil starter R is connected to the engine crankshaft S. However, the invention is envisioned to work with other arrangements.

In the preferred embodiment, the electric starter 10 is connected to the crankshaft S between the recoil starter R and the engine E. The electric starter 10 is connected to the crankshaft S in such a way that the recoil starter R can alternatively be used to start the engine E.

The electric starter 10 is directly and continuously connected to the crankshaft S.

In the preferred embodiment, the electric starter 10 further comprises an electric motor 12 and a source of power 14.

The electric motor 12 comprises a rotor 12A and a stator 12B. The rotor 12A is directly and continuously connected to the drive shaft S by a bolt or stud 13A which passes through a hole 13B in the rotor 12A. The stator 12B is fixed to the generator cover 52. The rotor 12A is positioned opposite the stator 12B.

The apparatus 10 may also comprise a start switch 16 between the source of power 14 and the electric motor 12. When the start switch 16 is turned to the "START" position, the electric motor 12 rotates and turns the crankshaft of the engine. The engine then starts.

Figure 5:
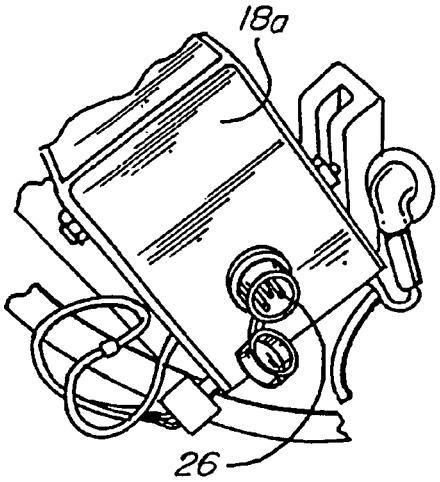
FIG. 5 is close-up perspective of the battery housing of the present invention.
Figure 6:
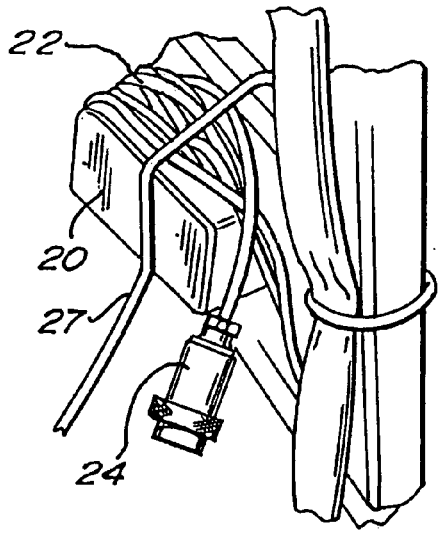
FIG. 6 is a close-up perspective of the battery charger of the present invention.
Figure 7:
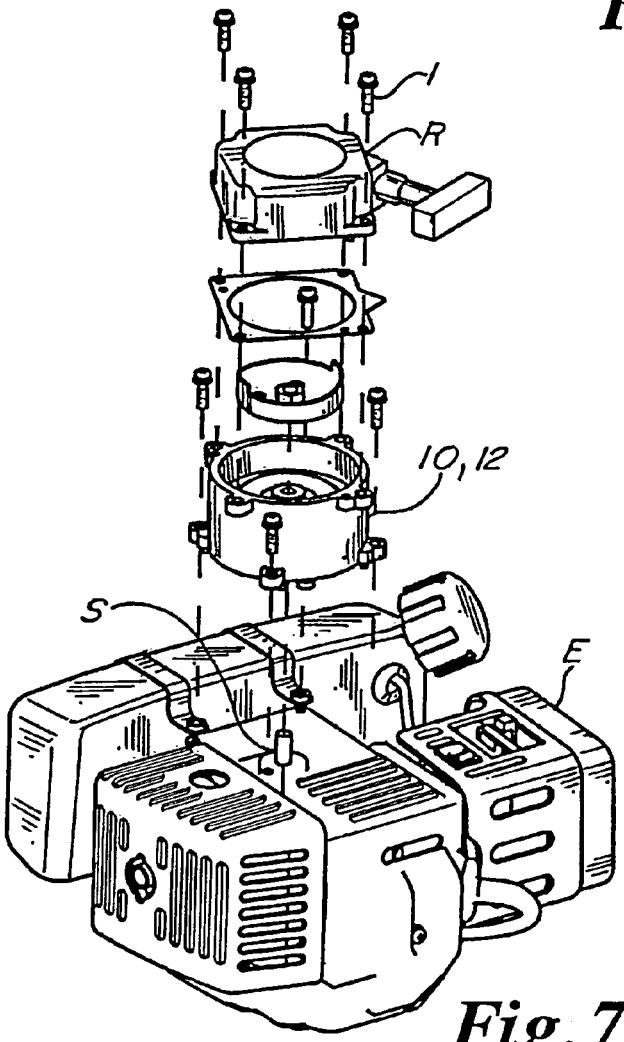
FIG. 7 is an exploded view of the present invention.

Preferably, the source of power is a battery 18 in a housing 18*a* but the source of power may alternatively be any connection to electric current, such as a generator or standard AC power. In one embodiment, the apparatus 10 further comprises a battery charger 20 which can be connected to standard AC power. The battery charger further has a detachable cord 22 with mating connectors 24, 26. (FIGS. 5 and 6) Note that the battery charger is not necessarily mounted on the cultivator as shown.

Once the engine starts, the start switch 16 is turned to an "ON" position in which current from the battery 18 is cut off.

Once the engine is started, the electric motor 12 becomes a generator that may supply electric current to the battery 18 to recharge the battery. This electric current is generated as the rotor 12A, connected to the rotating crankshaft, turns within the stator 12B.

Figure 8:
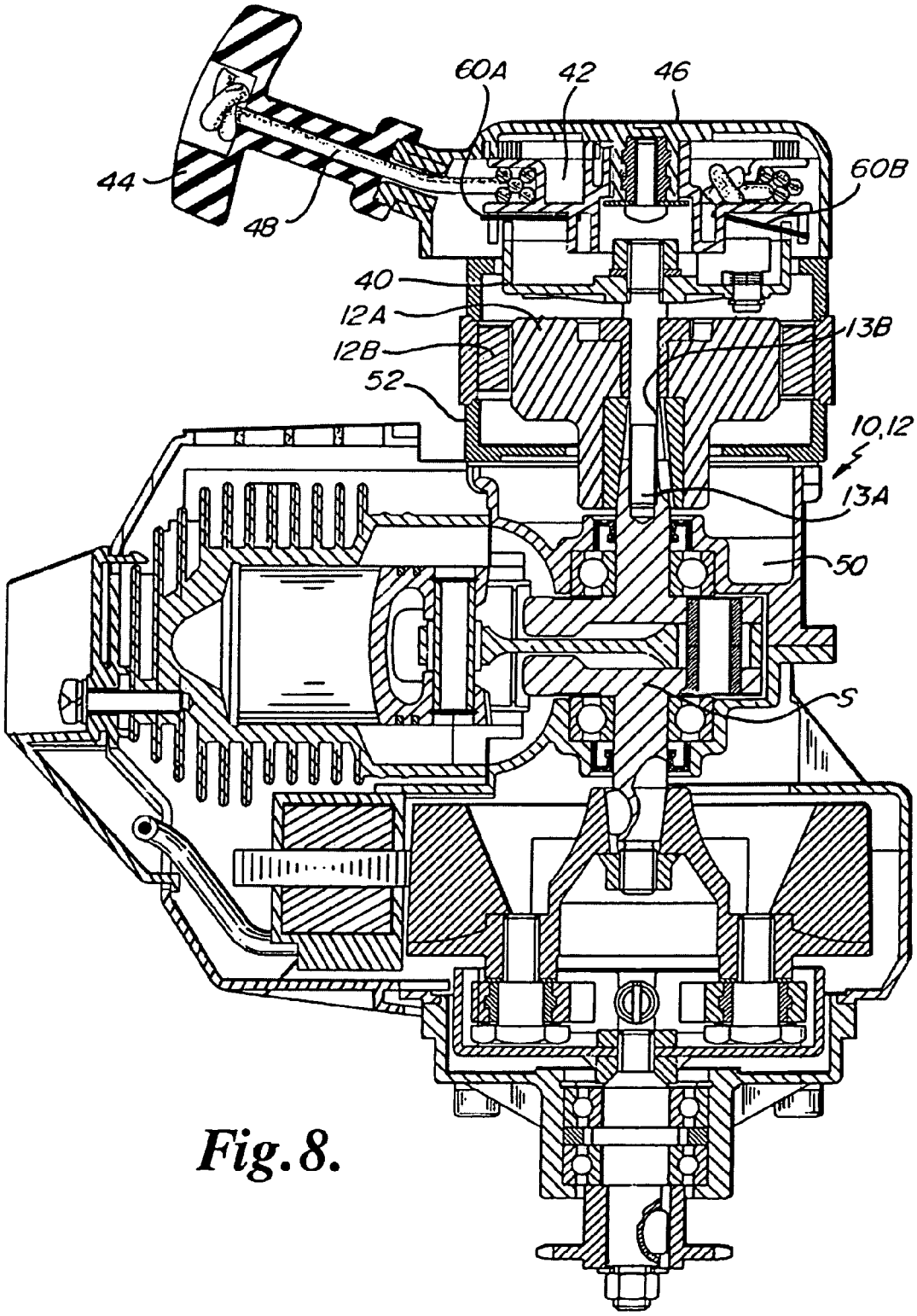
FIG. 8 is a cross-section of an engine showing the present invention.
Figure 9:
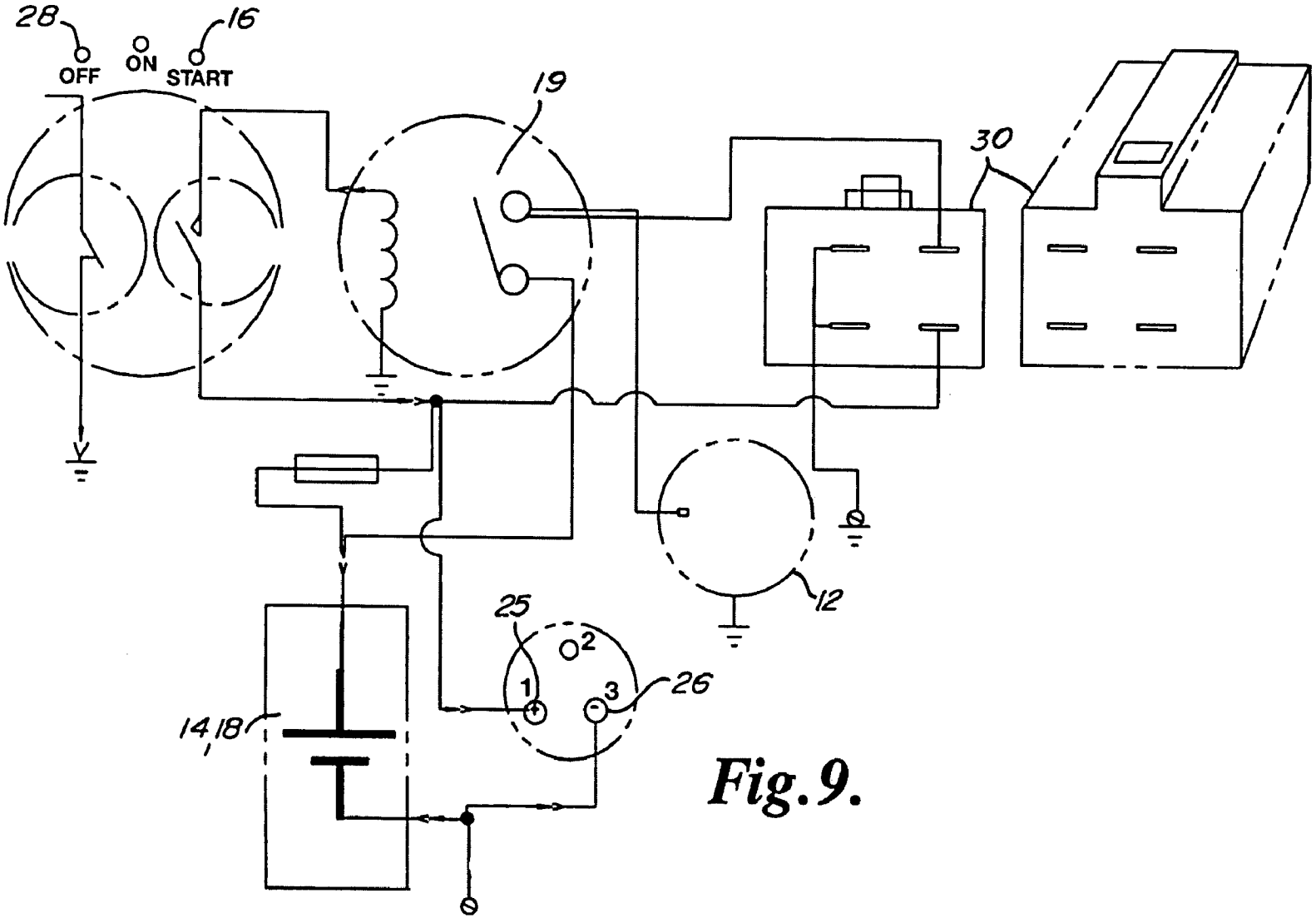
FIG. 9 is an electrical schematic of the present invention.

FIG. 8 is an electrical schematic of the starting system. The starter switch 16 is connected to the battery 18 and to a relay 19. When the starter switch 16 is closed, the relay 19 switches to complete the connection between the battery 18 and the motor 12. When the starter switch is moved to the "ON" position, the relay 19 switches to disconnect the battery 18 from the motor 12. The motor 12 then generates electric current which is carried to the relay 19 and thence through a regulator 30 to the battery 18, thus recharging the battery 18.

In the preferred embodiment, for safety reasons, the electric starter 10 further comprises a disable switch 28 that prevents starting of the engine.

The cultivator on which this invention is intended to be used conforms to the standard ANSI/OPEI B71.801996.

In one embodiment, the crankshaft S is intermittently connected to a recoil start, to allow the engine to be started manually.

The recoil start includes a recoil clutch assembly 40, recoil assembly 42, recoil handle 44, and recoil cover 46. A line 48 from the recoil assembly connects to the recoil handle 44.

Between the crankcase 50 and the recoil cover 46, is a generator cover 52. One side of the generator cover 52 is affixed to the crankcase 50 and the other side of the generator cover is affixed to the recoil cover 46. The rotor 12A and the stator 12B assembled with the generator cover 52 constitute the generator, as previously described. The bolt or stud 13A which connects the rotor 12A to the crankshaft S is suitably connected at its other end to the recoil clutch assembly 40.

With the engine stopped, the recoil assembly is disconnected from the recoil clutch assembly. Any suitable mechanism is envisioned to connect the recoil assembly to the recoil clutch. In the preferred embodiment, to start the engine manually, the operator pulls on the recoil handle 44. As the handle 44 continues to be pulled, a plurality of connector poles or rods 60 move from a position (A, FIG. 8) in which they are disengaged from the recoil clutch assembly to a position (B, FIG. 8) in which they engage the recoil clutch assembly. The recoil clutch assembly is then driven to rotate the rotor 12A to which it is affixed. The rotor 12A, being affixed to the crankshaft S, turns the crankshaft S, causing the engine to start.

When the recoil handle 44 is released, it returns to its original position suitably by a spring (not shown). As this occurs, the poles or rods 60 move out of engagement with the recoil clutch assembly. Thus, as the engine runs, the recoil clutch assembly free-wheels on the spinning rotor 12A.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. In a hand-supported, walk-behind cultivator having an engine and a recoil starter attached to the engine crankshaft, an electric starting apparatus for starting the engine, the apparatus comprising:

(a) an electric motor directly connected to the crankshaft whereby activation of the electric motor turns the crankshaft to start the engine;

(b) a source of power for the electric motor; and (c) wherein the electric motor is connected to the crankshaft between the recoil start and the crankshaft, thereby allowing the recoil start to also be used to start the engine.

2. The electric starting apparatus of claim 1, further comprising a start switch between the source of power and the electric motor.

3. The electric starting apparatus of claim 2, further comprising a disable switch preventing the engine from starting.

4. The apparatus of claim 2, wherein the source of power is a battery.

5. The apparatus of claim 4, further comprising a battery charger.

6. An electric starter for a walk-behind, powered, rotary cultivator having a gasoline engine having a crankshaft and a recoil starter connected to the gasoline engine, the electric starter comprising:

(a) an electric motor directly connected to the crankshaft without intermediate components whereby activation of the electric motor turns the crankshaft to start the engine; and (b) a source of power for the electric motor.

7. The electric starter of claim 6, further comprising a start switch between the source of power and the electric motor.

8. The electric starter of claim 7, further comprising a disable switch preventing the engine from starting.

9. The electric starter of claim 6, wherein the source of power is a battery.

10. The electric starter of claim 9, further comprising a battery charger.

11. An electric starter for a walk-behind, powered, rotary cultivator having a gasoline engine having a crankshaft and a recoil starter connected to the gasoline engine, the electric starter comprising:

(a) an electric motor directly connected to the crankshaft in-line between the recoil starter and the crankshaft whereby activation of the electric motor starts the engine and whereby the recoil starter can also be used to start the engine;

(b) a battery connected to the electric motor;

(c) a start switch between the battery and the electric motor; and (d) a battery charger.

12. The electric starter of claim 11, further comprising a disable switch preventing the engine from starting.

13. A walk-behind, powered, rotary cultivator having a gasoline engine having a crankshaft and a recoil starter connected to the gasoline engine, comprising:

(a) an electric motor directly connected to the crankshaft in-line between the recoil starter and the crankshaft;

(b) a battery connected to the electric motor; and (c) wherein the recoil starter is intermittently connected to the crankshaft through the electric motor.

14. The cultivator of claim 13, wherein the electric motor further comprises a rotor directly connected to the crankshaft and a stator positioned opposite the rotor.

15. The cultivator of claim 14, further comprising a recoil clutch assembly connected to the rotor and wherein the recoil starter is intermittently connected to the recoil clutch assembly.

16. The cultivator of claim 15, further comprising a plurality of rods pivotally connected to the recoil starter and movable between a first position in which the plurality of rods do not engage the recoil clutch assembly and a second position in which the plurality of rods engage the recoil clutch assembly.

17. The cultivator of claim 14, wherein the electric motor is also a generator supplying electric current to the battery to recharge the battery.

18. A walk-behind, powered, rotary cultivator having a gasoline engine having a crankshaft, comprising:

(a) a housing further comprising an electric motor directly connected to the crankshaft and a pull starter selectively engageable to the crankshaft to start the engine, wherein the electric motor is in-line between the pull starter and the crankshaft; and (b) a source of power for the electric motor.

* * * * *